US005375268A

United States Patent [19]

Chen

[11] Patent Number: 5,375,268

[45] Date of Patent: Dec. 27, 1994

[54] BALLFLOAT TOILET FLUSH CONTROL SYSTEM

[76] Inventor: Tsung-Ming Chen, 1 F. No. 2, Alley 19, Lane 184, Kuo Kwang Street, Chungho City, Taipei Hsien, Taiwan, Prov. of China

[21] Appl. No.: 125,863

[22] Filed: Sep. 24, 1993

[51] Int. Cl.[5] ..... E03D 3/12

[52] U.S. Cl. ..... 4/325; 4/415; 4/324

[58] Field of Search ..... 4/324, 325, 415

[56] References Cited

U.S. PATENT DOCUMENTS

| | | | |
|---|---|---|---|
| 4,175,296 | 11/1979 | Goldman | 4/325 |
| 4,189,795 | 2/1980 | Conti et al. | 4/324 |
| 4,225,987 | 10/1980 | Goldman et al. | 4/325 |
| 5,004,462 | 4/1991 | Mahler | 4/325 |

*Primary Examiner*—Henry J. Recla

*Assistant Examiner*—Gregory Vidovich

*Attorney, Agent, or Firm*—Varndell Legal Group

[57] ABSTRACT

The ballfloat toilet flush control system comprised of a master flush handle, a discharge valve controlled by the master flush handle, a float pivoted to a float holder on the overflow tube of the ballfloat toilet, an air tube connected between the air chamber of the discharge valve and an air passage on the float holder, an auxiliary flush handle, and an air passage control device controlled by the auxiliary flush handle, whereby the air passage control device tops the air passage, permitting water to be completely drawn out of the water tank of the ball float toilet as the master and auxiliary flush handles are simultaneously pressed; the air passage control device opens the air passage to let water enter the air chamber of the discharge valve so that the discharge valve stops the water outlet of the water tank before water is completely drawn out of the water tank when only the master flush handle is pressed.

1 Claim, 5 Drawing Sheets

BALLFLOAT TOILET FLUSH CONTROL SYSTEM

BACKGROUND AND SUMMARY OF THE INVENTION

The present invention relates to a ballfloat toilet flush control system which is alternatively controlled to let water be drawn away from the water tank at two different volumes.

In order to save water consumption, the flush control system of a ballfloat toilet is commonly designed for two-step controls, one for letting water be completely drawn out of the water tank, and the other for letting water be partially drawn out of the water tank. FIG. 1 illustrates a structure of this design. This flush control system uses a float for such two-step controls. As this flush control system needs much installation space, the size of the ballfloat toilet is relatively increased. Therefore, the transportation cost of the ballfloat toilet is high.

The present invention eliminates the aforesaid drawback. By fully utilizing the air chamber of the tank ball, the size of the float which is provided for controlling the two-step flush control is greatly reduced.

DETAILED DESCRIPTION OF THE PREFERRED EMBODIMENT

Figure 1:
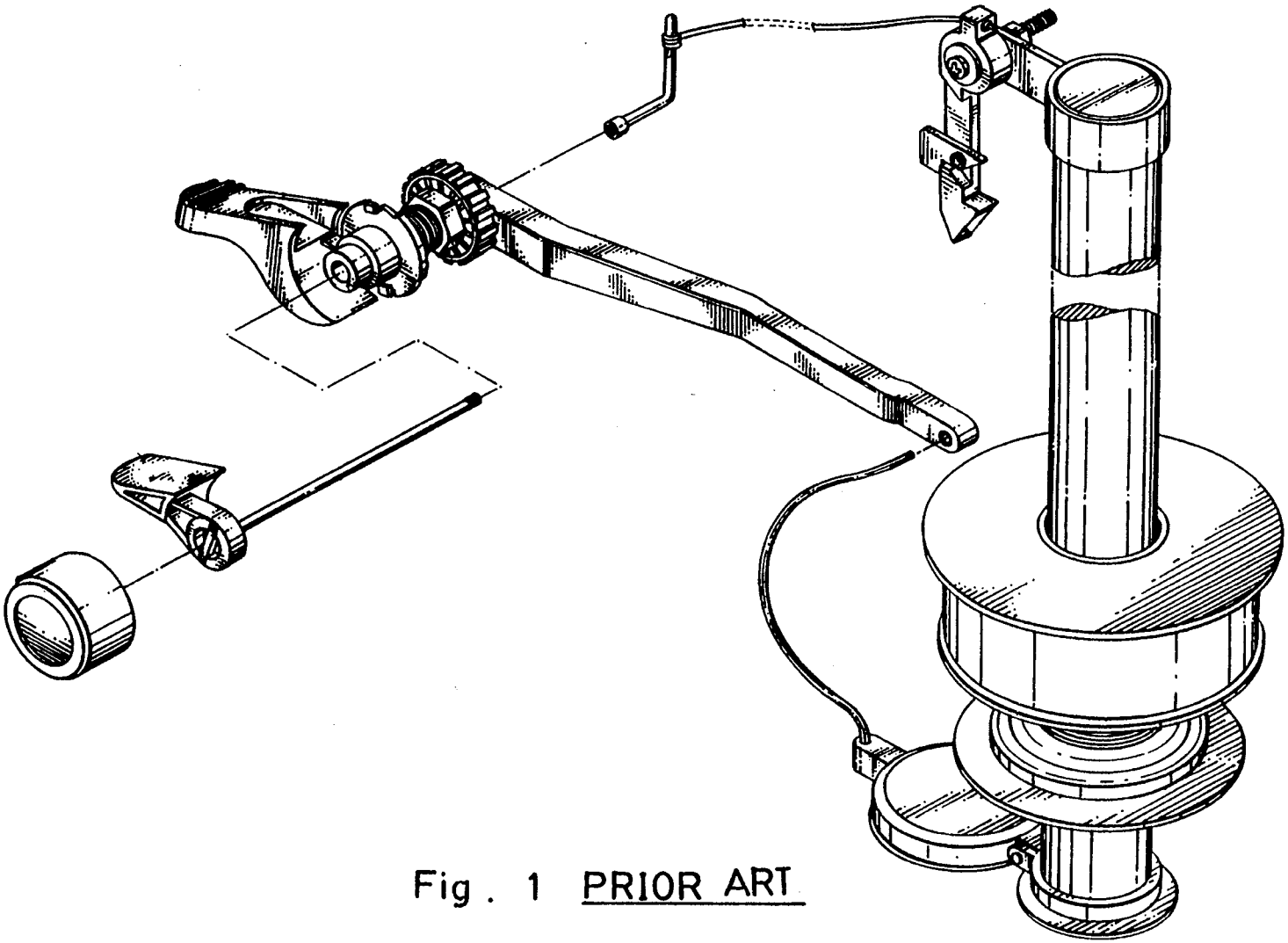
Fig. 1 PRIOR ART
FIG. 1 is an exploded view of the flush control system of a ballfloat toilet according to the prior art.
Figure 2:
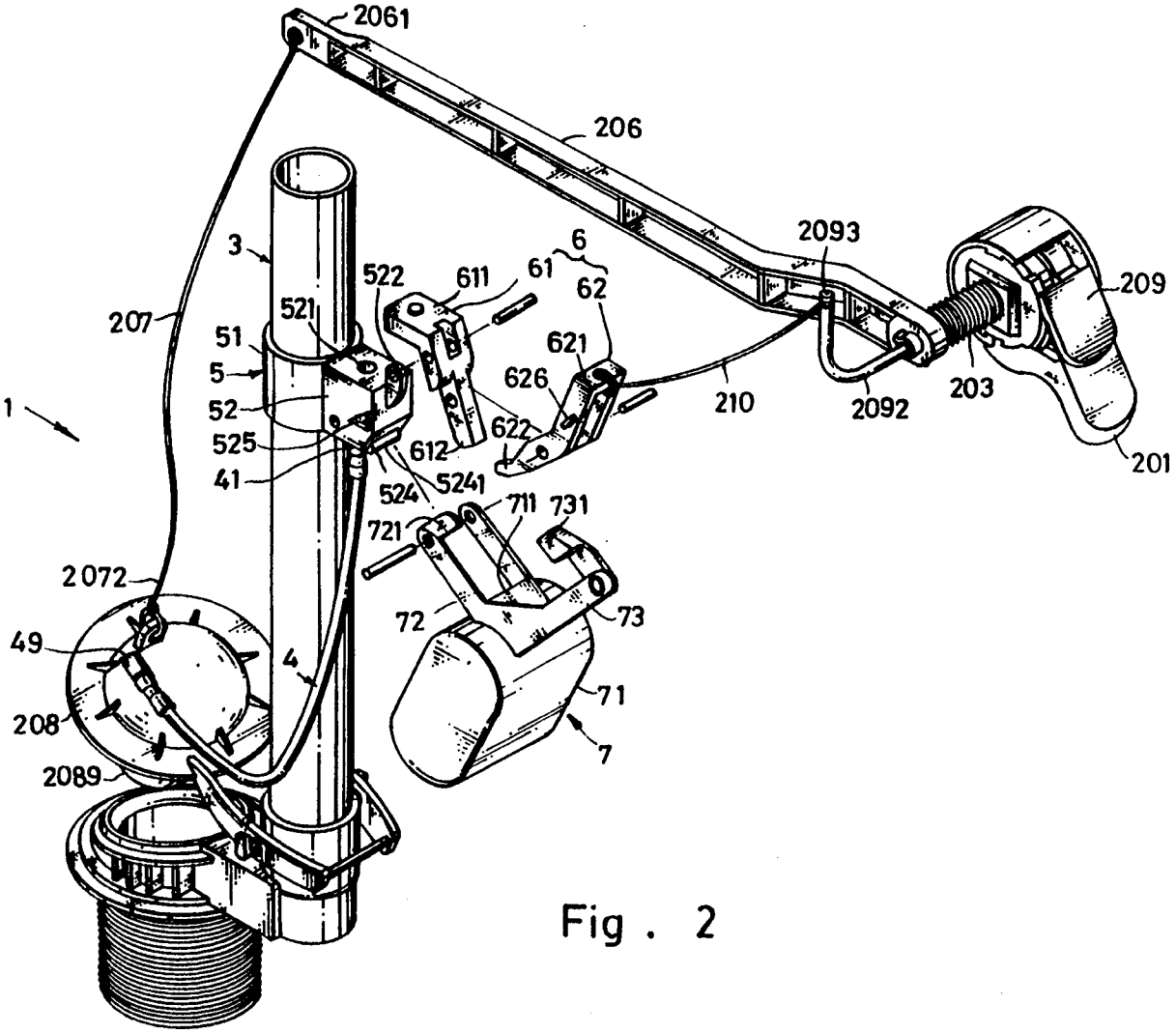
FIG. 2 is a perspective view of a flush control system for a ballfloat toilet according to the preferred embodiment of the present invention.

Referring to FIGS. 2, 3A, 3B and 4, a ballfloat toilet in accordance with the present invention is generally comprised of a water supply system and a flush control system. The water supply system is comprised of a water tank, a ball-cock assembly, an inlet tube, an overflow tube, and a float ball assembly. As the water supply system is made according to conventional techniques and is not within the scope of the invention, it is neither shown in the drawings nor described in the specification in detail.

The flush control system 1 is installed in the water tank of the water supply system, comprised of a master flush handle 201, a hollow screw member 203, a link 206, a lift wire 207, a discharge valve 208 having an air chamber 2089 therein, an air tube 4, an auxiliary flush handle 209, a connecting wire 210, a float holder 5, an air passage control device 6, and a float 7.

The hollow screw member 203 is fastened in a hole (not shown) on the water tank 220 of the water supply system by a nut (not shown) and a packing nut (not shown). The hollow screw member 203 is inserted with a connecting tube (not shown). The connecting tube has one end disposed inside the water tank 220 and coupled to the link 206 and an opposite end disposed outside the water tank and coupled to the master flush handle 201. The rear end 2061 of the link 206 is fastened with the lift wire 207. The rear end 2072 of the lift wire 207 is connected to the discharge valve 208. The discharge valve 208 comprises an air chamber 2089, and is lifted by the lift wire 207 to open the valve seat 221 of the water tank 220 so that a sudden rush of water is sent out of the water tank through the valve seat to wash the toilet bowl. The master flush handle 201 has a recessed chamber, which receives the auxiliary flush handle 209. The auxiliary flush handle 209 is pivoted about the connecting tube of the hollow screw member 203, having an axle 2092 inserted through the connecting tube of the hollow screw member 203 and extended into the water tank. The connecting wire 210 has one end connected to the rear end 2093 of the axle 2092, and an opposite end connected to the air passage control device 6. The float holder 5 comprises a mounting ring 51 mounted around the overflow tube 3 of the water supply system at a suitable elevation, a supporting frame 52 connected to the mounting ring 51. The supporting frame 52 comprises an air passage 521, a hooked portion 524 at the bottom and two stop blocks 525 bilaterally disposed at the bottom. The air passage control device 6 is comprised of two parts, namely, the first control member 61 and a second control member 62 pivoted together in the middle. The first control member 61 is pivoted between two opposite side walls 522 of the supporting frame 52 of the float holder 5, having an upper portion 611 attached with a water sealing pad 6111 for stopping the air passage 521 at the top, and a bottom portion 612 stopped against a top protection 711 on the float chamber 71 of the float 7. The second control member 62 comprises a top end 621 connected to the axle 2092 by the connecting wire 210, a bottom hook 622 releasably hooked on the hooked portion 524 of the supporting frame 52 of the float holder 5, and a projecting rod 626 at a suitable location. The float 7 comprises two opposite pivot arms 72 raised from the float chamber 71 thereof at the top and bilaterally pivoted to the supporting frame 52 of the float holder 5, a top projection 711 projected from the float chamber 71 and disposed corresponding to the bottom portion 612 of the first control member 61, a locating strip 721 respectively extended from one of the pivot arms 72 and stopped at one of the stop blocks 525 of the supporting frames 52 of the float holder 5, and a stop rod 73 having a top end 731 disposed adjacent to the projecting rod 626 on the second control member 62. The air chamber 2089 of the discharge valve 208 comprises an air hole 2088 connected to the bottom end 49 of the air tube 4. The top end 41 of the air tube 4 is fastened to the bottom wall of the supporting frame 52 of the float holder 5 and connected to the air passage 521.

Figure 3A:
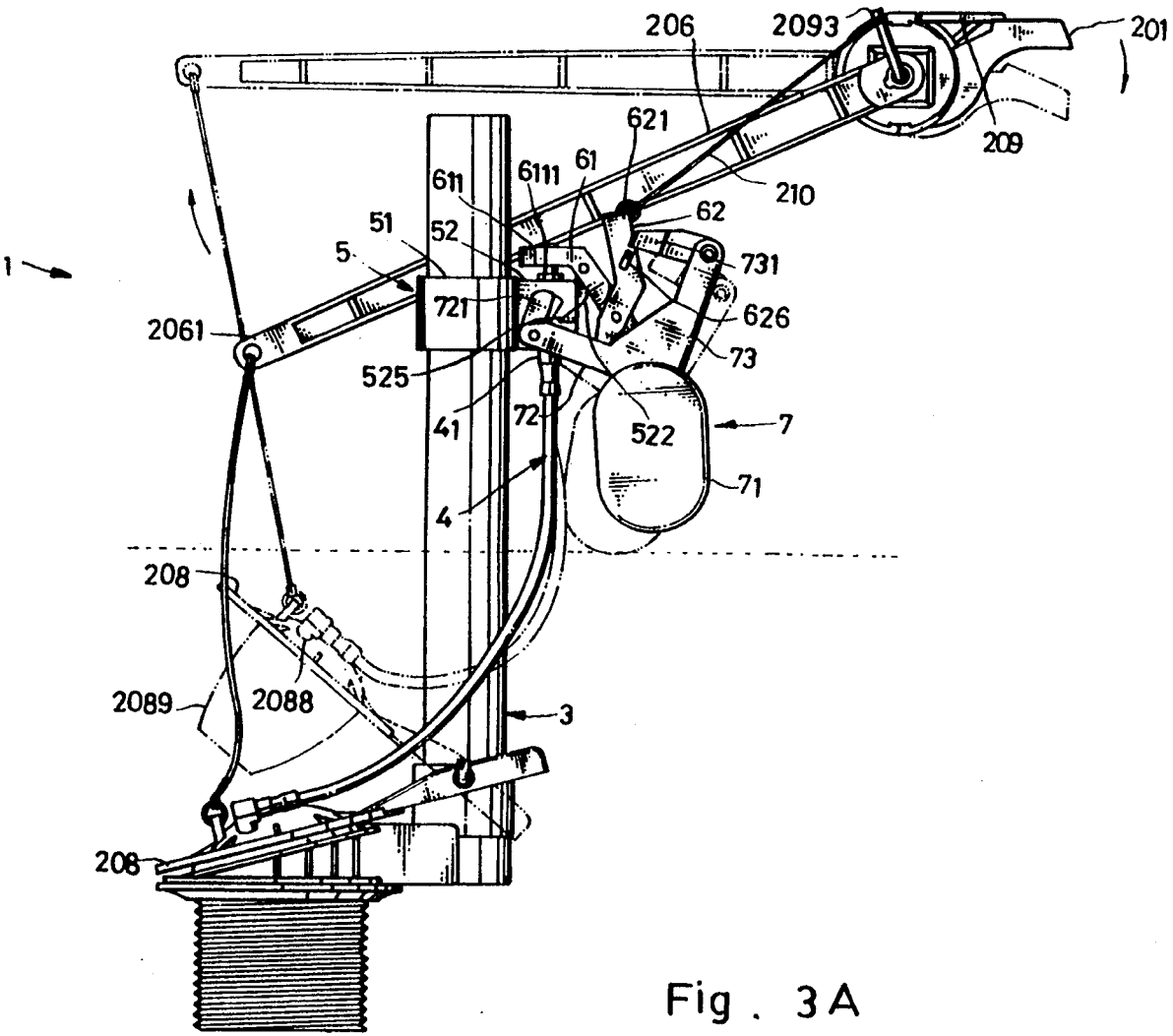
FIG. 3A shows the master flush handle of the flush control system of FIG. 2 pressed.
Figure 3B:
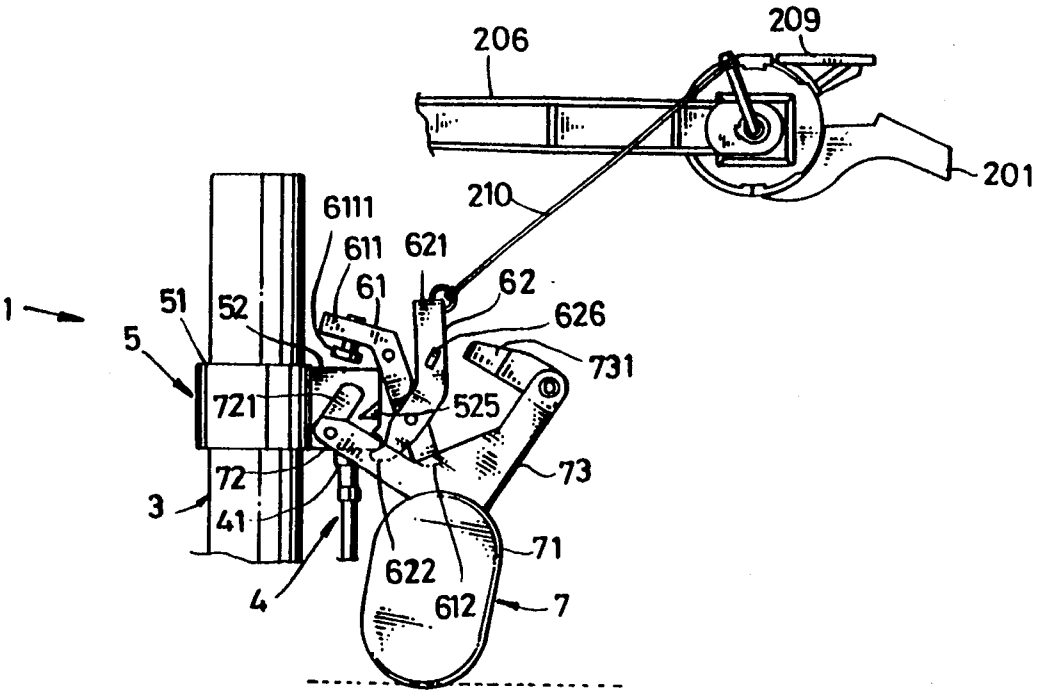
FIG. 3B is similar to FIG. 3A but showing the upper portion of the second control member of the air passage control device of the flush control system moved away from the air passage on the float holder.

Referring to FIGS. 3A and 3B, the flush control system 1 is alternatively controlled to send a sudden rush of water at different volumes. As the master flush handle 201 is pressed to lift the discharge valve 208 through the link 206 and the lift wire 207 for letting water be drawn away from the water tank 220, the float 7 gradully moves downward. As the float 7 moves downward, the top projection 711 of the float chamber 71 of the float 7 is released from the bottom portion 612 of the first control member 61, causing the upper portion 611 of the first control member 61 to be moved away from the air passage 521, and therefore water immediately enters the air chamber 2089 of the discharge valve 208 as air contained in the air chamber 2089 escapes therefrom via air hole 2088, air tube 4 and the opened air passage 521. As the water in chamber 2089 of the discharge valve 208 is filled up with water, it falls immediately to close the valve seat 221 of the water tank, and therefore only a partial volume of water is drawn away from the water tank.

Figure 4:
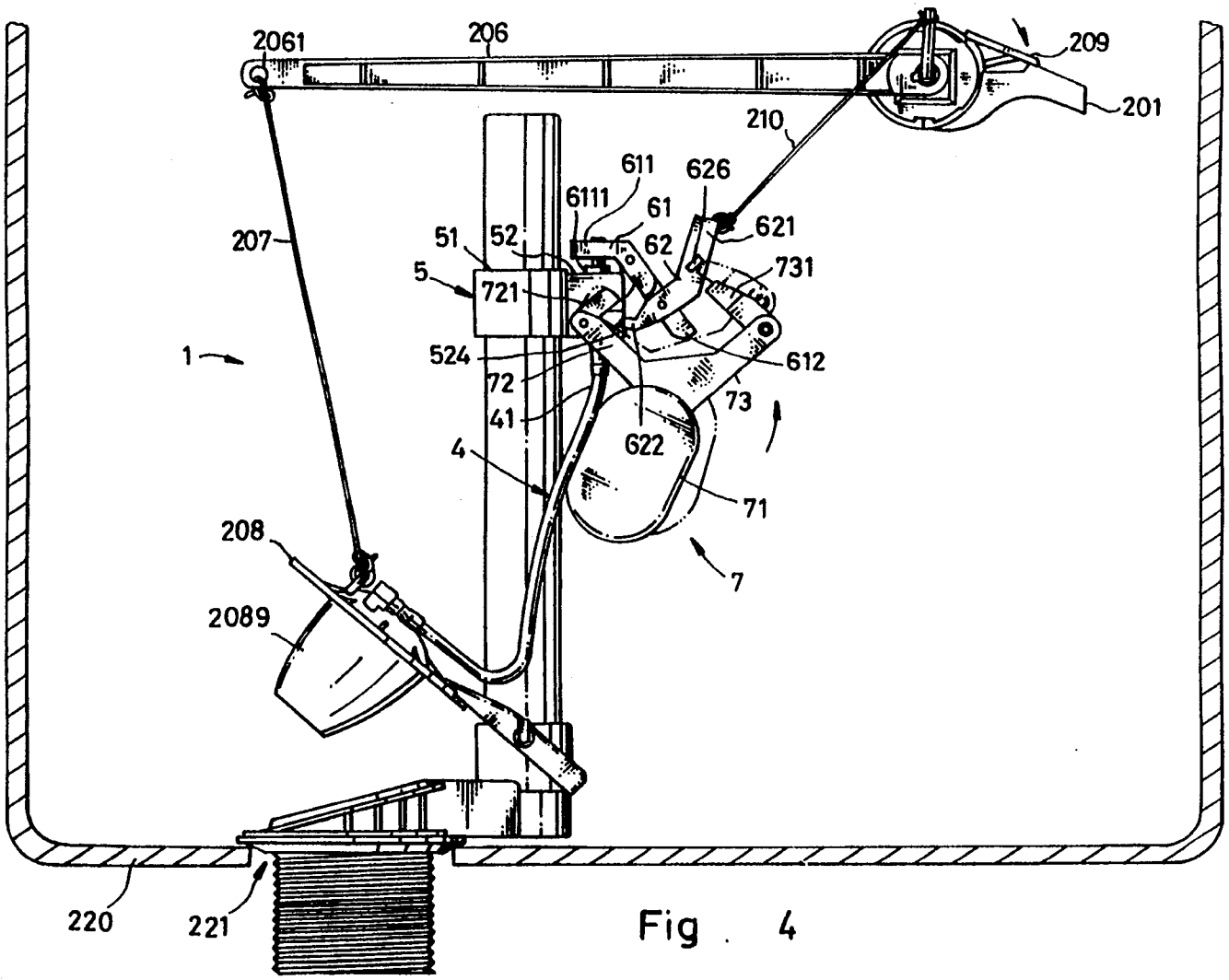
FIG. 4 shows the auxiliary flush handle and the master flush handle simultaneously pressed and the flush control system of the present invention arranged in a water tank.

Referring to FIG. 4, as the auxiliary flush handle 209 is pressed, the master flush handle 201 is simultaneously pressed, and therefore the lift wire 207 is pulled by the link 206 to lift the discharge valve 208 from the valve seat for permitting water be drawn away from the water tank, and at the same time, the connecting wire 210 is pulled by the axle 2092 to carry the top end 621 of the second control member 62 outward relative to the first control member 61, causing the bottom hook 622 of the second control member 62 to hook on the top edge 5241 of the hooked portion 524, and therefore the upper portion 611 of the first control member 61 is forced by the second control member 62 to maintain the air passage 521 of the hollow supporting frame 52 of the float holder 5 closed. This permits the float 7 to move downward to its lower limit position without any effect on the opening and closing of the air passage 521. As water is completely drawn out of the water tank, the water supply system is immediately activated to supply water to the water tank again, causing the flush control system 1 to return to its former position.

I claim:

1. A flush control system for use in a ballfloat toilet having a water tank with a valve seat and an overflow tube for controlling an mount of water suddenly flushed out of said water tank through said valve seat, said flush control system including a master flush handle adapted to be externally arranged on said water tank, a link coupled to said master flush handle, a discharge valve adapted to be mounted to said valve seat having an air chamber therein connected to said link by a lift wire and controlled by said master flush handle to open and close said valve seat, an auxiliary flush handle received in a hole on said master flush handle, a float holder adapted to be mounted on said overflow tube, an air passage control device pivoted to said float holder and connected to said auxiliary flush handle by a connecting wire, a float pivoted to said float holder, and an air tube having a first end connected to said discharge valve and communicating with said air chamber and an opposite end connected to said float holder;

said float holder comprising a mounting ring mounted around said overflow tube, a hollow supporting frame connected to said mounting ring; said hollow supporting frame comprising an air passage having a bottom connected to said opposite end of said air tube, a hooked portion disposed on a bottom portion of said supporting frame, and a stop block disposed on a bottom of said supporting frame;

said air passage control device comprising first and second control members respectively pivoted together at middles thereof; said first control member pivoting on said supporting frame of said float holder, having an upper portion opening and closing said air passage and a bottom portion disposed against said float; said second control member comprising a top end connected to said connecting wire, a bottom hook releasably hooked on said hooked portion of said supporting frame, and a projecting rod;

said float having two opposite pivot arms bilaterally pivoted to said supporting frame, a float chamber having a top projection disposed against said bottom portion of said first control member, a locating strip respectively extending from one of said pivot arms and adapted to abut said stop block of said supporting frame, and a stop rod adapted to be disposed against said projecting rod of said second control member;

wherein when said master flush handle is pushed separately from said auxiliary flush handle, said discharge valve is lifted from said valve seat permitting water to flow through said valve seat, and said float moves downward to release said first and second control members for opening said air passage and causing said air chamber of said discharge valve to fill with water and displace air in said air chamber to said air passage thereby closing said valve seat before water is completely drawn out of said water tank: and wherein when said master flush handle and said auxiliary handle are pushed together, said bottom hook of said second control member hooks on said hooked portion of said supporting frame, holding said upper portion of said first control member on said air passage for closing said air passage while said float moves downward thereby permitting water to be completely drawn out of said water tank.

* * * * *